US010752022B2

(12) United States Patent
Klemann et al.

(10) Patent No.: US 10,752,022 B2
(45) **Date of Patent: *Aug. 25, 2020**

(54) MULTILAYER IMAGING WITH A HIGH-GLOSS CLEAR INK LAYER

(71) Applicant: ELECTRONICS FOR IMAGING, INC., Fremont, CA (US)

(72) Inventors: Bruce Klemann, Concord, NH (US); Joshua Mcgrath, Gilford, NH (US); John Duffield, Meredith, NH (US)

(73) Assignee: ELECTRONICS FOR IMAGING, INC., Fremont, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/011,306

(22) Filed: Jun. 18, 2018

(65) Prior Publication Data

US 2018/0304647 A1 Oct. 25, 2018

Related U.S. Application Data

(63) Continuation of application No. 15/093,678, filed on Apr. 7, 2016, now Pat. No. 10,000,075.
(Continued)

(51) Int. Cl.

| | |
|---|---|
| ***B41M 7/00*** | (2006.01) |
| ***B41J 11/00*** | (2006.01) |
| ***B41J 2/21*** | (2006.01) |

(52) U.S. Cl.
CPC ..... *B41J 11/002* (2013.01); *B41J 2/2114* (2013.01); *B41J 11/0015* (2013.01);
(Continued)

(58) Field of Classification Search
CPC ..... B41J 11/002; B41J 11/0015; B41J 2/2114; B41M 7/0081; B41M 7/0045; B41M 7/0027
See application file for complete search history.

(56) References Cited

U.S. PATENT DOCUMENTS

| | | | |
|---|---|---|---|
| 8,684,511 | B2 | 4/2014 | Lahut et al. |
| 8,833,922 | B2 | 9/2014 | Edwards |

(Continued)

FOREIGN PATENT DOCUMENTS

| | | | |
|---|---|---|---|
| CN | 103269860 | A | 8/2013 |
| CN | 104228382 | A | 12/2014 |

(Continued)

*Primary Examiner* — Sharon A. Polk
(74) *Attorney, Agent, or Firm* — Perkins Coie LLP

(57) ABSTRACT

Various embodiments concern inkjet printing systems designed for multilayer imaging with a high-gloss clear ink layer. More specifically, the inkjet printing systems are designed so that clear, curable inks are provided additional time to level out before being cured. The settling process enables the inkjet printing systems to produce multilayer images having high gloss values. For example, a bracket could be attached to a curing assembly that prevents radiation from striking a certain portion of the substrate onto which clear ink has recently been deposited. As another example, an inactive array of light-emitting diodes may be disposed in line with the print head(s) responsible for depositing clear ink. Moreover, various embodiments also allow for true multilayer printing of a color coat and a high-gloss clear coat in a single step (e.g., by arranging print heads into rows within a printer carriage).

20 Claims, 9 Drawing Sheets

Related U.S. Application Data

(60) Provisional application No. 62/144,754, filed on Apr. 8, 2015.

(52) U.S. Cl.
CPC ..... *B41M 7/0045* (2013.01); *B41M 7/0081* (2013.01); *B41M 7/0027* (2013.01)

(56) References Cited

U.S. PATENT DOCUMENTS

| | | | | |
|---|---|---|---|---|
| 10,000,075 | B2 * | 6/2018 | Klennann | B41J 11/002 |
| 2002/0122106 | A1 | 9/2002 | Ylitalo | |
| 2003/0227527 | A1 * | 12/2003 | Richards | B41J 11/002 347/102 |
| 2006/0023045 | A1 | 2/2006 | Yokoyama et al. | |
| 2006/0075917 | A1 | 4/2006 | Edwards et al. | |
| 2007/0070162 | A1 | 3/2007 | Yokoyama | |
| 2008/0192101 | A1 * | 8/2008 | Hoshino | B41J 11/002 347/102 |
| 2010/0194838 | A1 | 8/2010 | Mitsuzawa | |
| 2011/0310204 | A1 | 12/2011 | Ohnishi | |
| 2012/0069109 | A1 * | 3/2012 | Anderson | B41M 7/0081 347/102 |
| 2012/0069112 | A1 | 3/2012 | Wanibe | |
| 2012/0147095 | A1 * | 6/2012 | Miura | C09D 11/101 347/47 |
| 2013/0127960 | A1 | 5/2013 | Edwards et al. | |
| 2013/0271541 | A1 | 10/2013 | Ohkawa et al. | |
| 2013/0293609 | A1 * | 11/2013 | Ohkawa | B41J 11/002 347/9 |
| 2014/0370214 | A1 | 12/2014 | Araki et al. | |
| 2015/0273868 | A1 * | 10/2015 | Vodopivec | B41J 3/543 347/102 |

FOREIGN PATENT DOCUMENTS

| | | | |
|---|---|---|---|
| EP | 1870239 | A2 | 12/2007 |
| EP | 2360018 | A1 | 8/2011 |
| EP | 3318404 | A1 | 5/2018 |
| JP | 5028862 | B2 | 7/2012 |
| JP | 2013132791 | A | 7/2013 |
| WO | 2014126578 | A1 | 8/2014 |
| WO | 2015110619 | A1 | 7/2015 |

* cited by examiner

| | 60° Gloss of Color Blocks | | | | | |
|---|---|---|---|---|---|---|
| Print Sample | Cyan | Magenta | Yellow | Black | Red | Average |
| Embodiment of Figure 3: UV-Curable Inkjet Printing System Including Mercury Arc Lamp, Version 1 | 80.4 | 80.2 | 87.1 | 83.3 | 68.8 | 80.0 |
| Embodiment of Figure 3: UV-Curable Inkjet Printing System Including Mercury Arc Lamp, Version 2 | 89.0 | 89.5 | 91.2 | 88.3 | 90.0 | 89.6 |
| Standard Configuration of UV-Curable Inkjet Printing System Including Mercury Arc Lamp | 18.8 | 18.2 | 17.1 | 17.1 | 16.7 | 17.6 |
| Embodiment of Figure 4: UV-Curable Inkjet Printing System Including LED Arrays | 92.8 | 92.1 | 93.4 | 93.1 | 93.4 | 93.0 |
| Standard Configuration of UV-Curable Inkjet Printing System Including Lamps | 13.6 | 14.5 | 15.7 | 13.9 | 14.3 | 14.4 |

FIGURE 6

MULTILAYER IMAGING WITH A HIGH-GLOSS CLEAR INK LAYER

CROSS-REFERENCE TO RELATED APPLICATIONS

This application is a continuation of U.S. patent application Ser. No. 15/093,678, filed Apr. 7, 2016, which claims the benefit of U.S. Provisional Patent Application No. 62/144,754, filed Apr. 8, 2015, the entirety of which are incorporated herein by this reference thereto.

RELATED FIELD

Various embodiments relate generally to inkjet printing and curing. More particularly, various embodiments concern inkjet systems configured for multilayer imaging with a high-gloss clear ink layer.

BACKGROUND

Inkjet printing and energy-curable inks have experienced significant development over the last decade. In general, these developments have focused on more effective and efficient means to cure the ink after it has been deposited onto a substrate. The first energy-curable inkjet printing systems used medium pressure Mercury (vapor) bulbs. These bulbs were capable of producing a significant peak intensity ($W/cm^2$) and doses of UV radiation ($J/cm^2$) in a variety of wavelengths.

Several different approaches have been taken with respect to inkjet printing and radiation (e.g., ultraviolet) curing, including:

- Initially printing a color layer on media, reversing the direction of the media, and then moving the media back to the start of the color layer. The print settings are then changed, and the color layer is overprinted with a layer of clear ink.
- Initially printing a color layer on media, removing the media from the printing system, reinserting the media at the back of the printing system, and then overprinting the color layer with a layer of clear ink using different settings.
- For flatbed printers, which are not suitable for printing on flexible media, either the rigid media or the print heads are fixed in place, and the un-fixed component (i.e., the media or the print heads) is moved on an X-Y table. These configurations allow printed areas of the media to be accessed again and a layer of clear ink to be overprinted on color layers.

In each of the foregoing approaches to inkjet printing, there is a need to give the clear, radiation-curable ink sufficient time to level out before it is cured so that the gloss can be maximized.

SUMMARY

Introduced herein are inkjet printing systems and techniques for improving the gloss of multilayer images printed on a substrate. These inkjet printing systems provide clear, curable inks additional time to settle and level out before being cured. Said another way, the inkjet printing systems described herein prevent clear ink from being immediately exposed to a curing assembly and instead selectively introduce the clear ink to the curing assembly after a certain amount of time (e.g., seconds or minutes after being deposited onto a substrate).

Various embodiments described herein allow for true multilayer printing of a color layer and a clear layer in a single step. For example, colored ink(s) could be deposited onto the substrate by a first row of print heads, and clear ink could be deposited onto the substrate by a second row of print heads. Clear ink is typically ejected on top of a color layer so that the clear layer can act as a protective overcoat (e.g., for outdoor weathering, abrasion resistance, or anti-graffiti), gloss flood coat or varnish, or spot gloss. However, clear ink could also be ejected directly onto the substrate (e.g., as a primer).

The clear ink is given time to settle before being exposed to a curing assembly. This can be accomplished by making structural adjustments to the inkjet printing system. For example, a bracket could be attached to the curing assembly that prevents radiation from striking a section of the substrate onto which clear ink has been deposited. As another example, a barrier could be erected immediately prior to the clear ink print head(s) that shields the recently-deposited clear ink from radiation.

The inkjet printing system may include a single curing assembly or multiple curing assemblies. For example, a first curing assembly could be configured to cure the color layer, while a second curing assembly could be configured to cure the clear layer. In some embodiments, the first and second curing assemblies are configured to emit different types of radiation. For example, the first curing assembly may be configured to emit electromagnetic radiation of subtype C (UVC), and the second curing assembly may be configured to emit electromagnetic radiation of subtype A (UVA), subtype B (UVB), subtype V (UVV), or a combination thereof.

BRIEF DESCRIPTION OF THE DRAWINGS

One or more embodiments of the present disclosure are illustrated by way of example and not limitation in the figures of the accompanying drawings, in which like references indicate similar elements.

FIG. 6 is a table that shows a comparison of gloss values for different color blocks onto which a clear overcoat has been printed using various embodiments described herein and conventional printer setups.

DETAILED DESCRIPTION

Systems and techniques for multilayer imaging with a high-gloss clear ink layer are described herein. For the purposes of illustration and ease of understanding, the term "layer" includes any type of coating or primer, unless the context specifically notes otherwise. These systems and techniques provide clear, curable (e.g., ultraviolet-curable) inks sufficient time to level out before being cured so that the gloss can be maximized.

Various embodiments allow for true multilayer printing of a color coat (e.g., a color image) and a high-gloss clear coat in a single step. That is, multilayer printing can be accomplished without moving the print media backward, removing and reinserting the print media into the printing system, or incorporating a second step. Various embodiments also allow multilayer prints to be executed on roll-to-roll inkjet printers and on hybrid inkjet printers that are capable of printing on both flexible roll-form print media and rigid print media (e.g., individual sheets).

The systems described herein allow clear coatings to flow out and level so that it can act as a primer, protective overcoat (e.g., for outdoor weathering, abrasion resistance, or anti-graffiti), gloss flood coat or varnish, or spot gloss.

The following description provides certain specific details for a thorough understanding and enabling description of these embodiments. One skilled in the relevant technology will understand, however, that some of the embodiments may be practiced without many of these details.

Likewise, one skilled in the relevant technology will also understand that some of the embodiments may include many other features not described in detail herein. Additionally, some well-known structures or functions may not be shown or described in detail below to avoid unnecessarily obscuring the relevant descriptions of the various examples.

The terminology used below is to be interpreted in its broadest reasonable manner, even though it is being used in conjunction with a detailed description of certain specific examples of the embodiments. Indeed, certain terms may even be emphasized below; however, any terminology intended to be interpreted in any restricted manner will be overtly and specifically defined as such in this Detailed Description section.

System Overview

Figure 1:
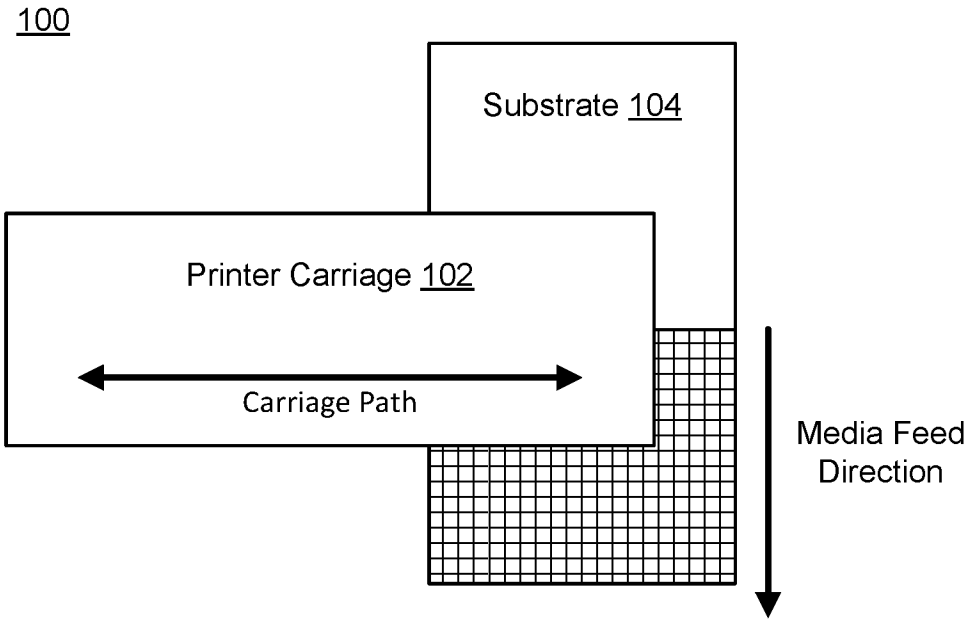
FIGURE 1 (PRIOR ART)
FIG. 1 depicts the feed direction of media (also referred to herein as a "substrate") as it advances through an inkjet printing system.

FIG. 1 depicts the feed direction of media (also referred to herein as a "substrate") as it advances through an inkjet printing system 100. The inkjet printing system 100 could be a conventional inkjet hybrid or roll-to-roll printer. An inkjet printing system 100 typically includes a printer carriage 102 that contains one or more print heads that deposit inks or other fluids onto the flexible or rigid substrate 104. FIG. 1 also depicts the path of a printer carriage 102 that shuttles laterally across the substrate 104. The path traversed by the printer carriage 102 as it shuttles laterally across the substrate 104 is normally substantially perpendicular to the media feed direction.

Figure 2:
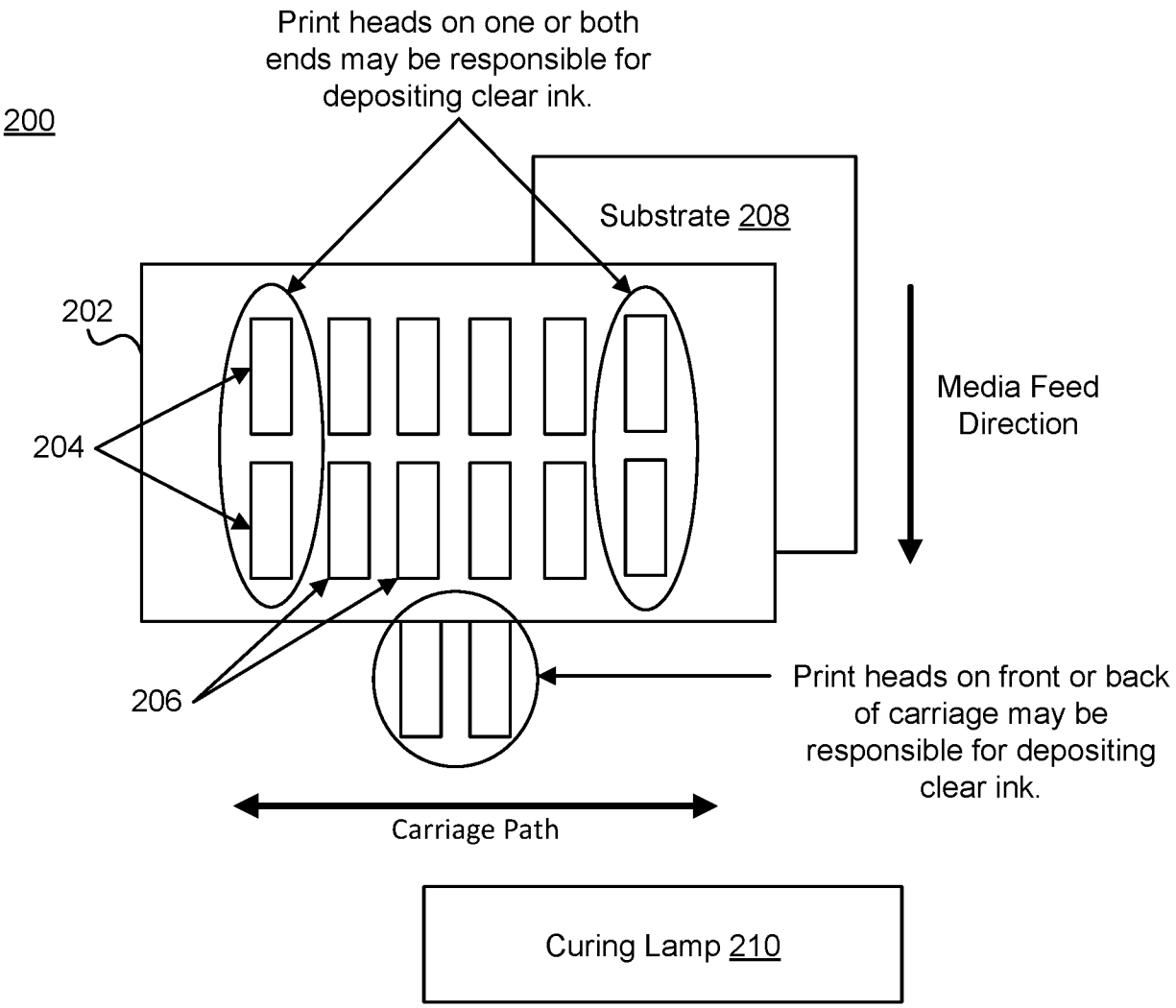
FIG. 2 is a diagram of an inkjet printing system that is configured to deposit both colored ink and clear ink on a substrate.

FIG. 2 is a diagram of an inkjet printing system 200 configured to deposit both colored ink and clear ink on a substrate 208. Many inkjet printing systems include at least one print head that applies a clear, curable ink or fluid to the substrate 208. Here, for example, the inkjet printing system 200 includes a printer carriage 202 that houses print heads 204 that eject clear ink and print heads 206 that eject colored ink. However, as noted above, conventional inkjet printing systems do not provide the clear ink sufficient time to settle and level out before being cured.

Some of the printing systems described herein position the print head(s) 204 that are responsible for depositing clear ink in a particular arrangement. For example, the print head(s) 204 may be in line with the print heads 206 responsible for ejecting colored ink, may be placed in front of or behind the other print heads 206 (e.g., in a separate row), or may be attached to the front or back of the printer carriage 202.

When the print heads 204, 206 in a printer carriage 202 are arranged in multiple rows, it is possible to print multiple layers on top of one another (i.e., produce a multilayer print) in a single pass of the substrate 208 through the printing system 200. For example, printing systems whose carriages shuttle back and forth laterally across a substrate may use a first row of print head(s) to print a color layer (e.g., an image or text) and a second row of print head(s) to print a clear layer. The clear layer may cover some or all of the color layer. For example, clear ink may only be deposited on a portion of a color image.

To achieve both high print quality for the color layer and high gloss of the clear layer in a multilayer construction, a section of a curing lamp 210 may be covered or disabled. More specifically, the colored ink can be deposited on a segment of substrate that is exposed to an active area of the curing lamp 210 immediately or very soon after printing. However, the curing lamp 210 may be blocked or turned off in an inactive area that passes over the clear ink. Eventually, as the substrate 208 advances through the printing system 200, the clear ink moves past the inactive area of the curing lamp 210 and reaches a position where the clear ink is exposed to sufficient radiation to initiate the curing process. The duration of time during which the clear ink is not exposed to radiation (also referred to as "time-to-lamp") is sufficiently large to allow the individual droplets of clear ink to flow together and level out, which yields a higher gloss than would otherwise occur.

Time-to-lamp for the clear ink can also be increased incrementally by curing with a lamp that leads the print heads 204, 206 and the carriage 202 as it traverses the media 208 and by printing uni-directionally. Depending on the clear ink composition, the type of substrate, and the type of curing system, it may be necessary to allow the clear ink to flow out for tens of seconds or even minutes in order to maximize the gloss level of the clear layer.

Figure 3:
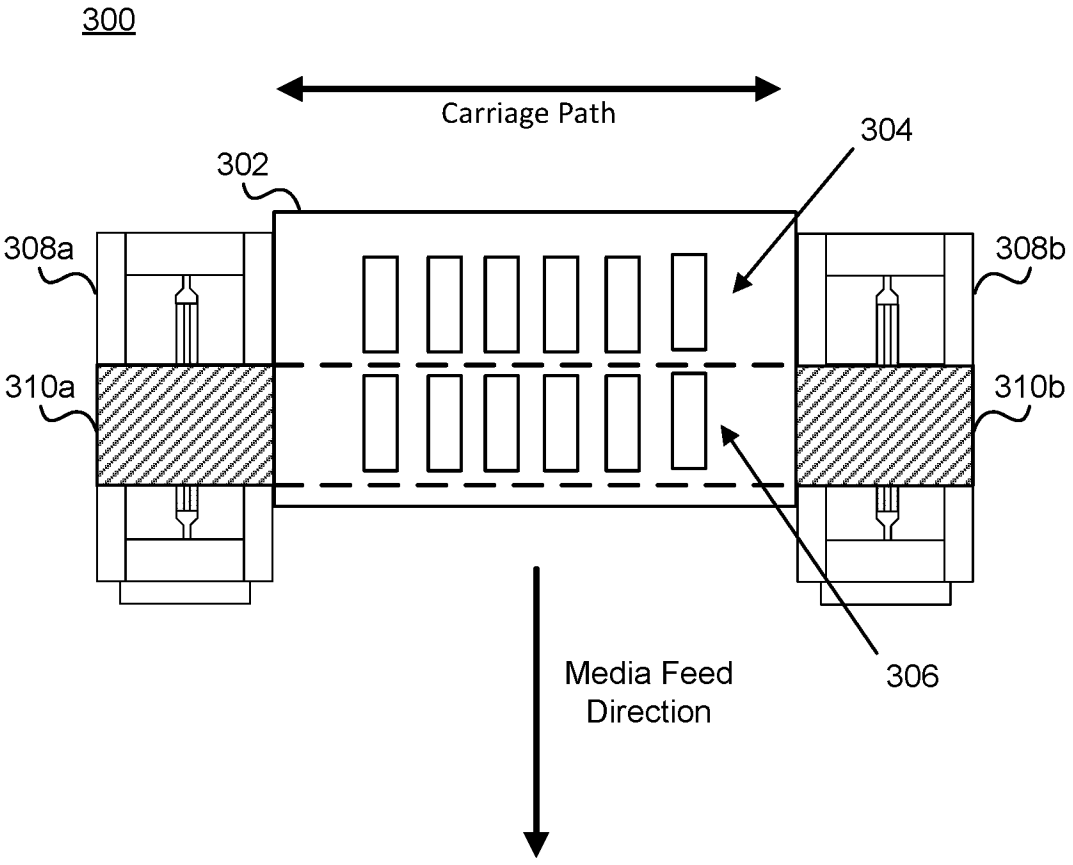
FIG. 3 depicts the underside of an inkjet printing system that is able to cure ink deposited on a substrate using one or more curing assemblies.

Many different combinations of layers could be used for multilayer printing as long as the top layer comprises at least some clear ink. For example, the top layer could include patches of both clear ink and colored inks or only patches of clear ink, or could be a flood coat of clear ink. Several examples of possible combinations of layers are listed below. Note that some images may include four or more layers, even though many of the embodiments described herein may only include two or three layers:

- Color—Clear
- Color—Clear—Clear
- Clear Primer—Color—Clear
- Clear Primer—White—Color—Clear
- White—Color—Clear
- White—White—Color—Clear
- White—Color—Clear—Clear
- Black Block Out Layer On Transparent Media—Color—Clear
- Black Block Out Layer On Transparent Media—White—Color—Clear
- Color On Transparent Media—White—Color—Clear FIG. 3 depicts the underside of an inkjet printing system 300 that is able to cure ink deposited on a substrate using one or more curing assemblies 308*a-b*. Colored inks are initially deposited on the substrate by one or more colored ink print heads 304, and at least partially cured by active sections of the curing assemblies 308*a-b*. The colored ink print head(s) 304 may be arranged in a row as shown in FIG. 3. The curing assemblies 308*a-b*, meanwhile, could be curing lamps that are disposed on opposite sides of the printer carriage 302.

When the color image advances into the dead zone delineated by dashed lines, clear ink can be deposited on top of the color image by one or more clear ink print heads 306. For example, the clear ink could be deposited by a second row of print head(s) or a subset of the print heads in the second row (e.g., only the outermost print heads on each end). In some embodiments, a portion of each curing assembly 308*a-b* is blocked (as shown by crosshatched areas 310*a-b*) so that the section of substrate between the dashed lines is not exposed to any radiation from the curing assemblies 308*a-b*.

Once that section of the substrate advances past the lower dashed line, the clear ink can be cured by radiation emitted by the curing assemblies 308*a-b*. In some embodiments, the inkjet printing system 300 is configured to transport the substrate at a particular speed so that the clear ink is provided sufficient time to settle before being exposed to the curing assemblies 308*a-b*. For example, a conveyor may advance the substrate at a particular speed while depositing ink on the substrate, and then decrease the speed of advancement (or halt advancement entirely) when the section of the substrate resides within the dead zone.

The colored ink(s) and the clear ink(s) deposited onto the substrate may be, for example, a solid curable ink, a water-based curable ink, or a solvent-based curable ink. The curing assemblies 308*a-b* could include fluorescent bulbs, light emitting diodes, low pressure bulbs, or exited dimer (excimer) lamps and/or lasers. For example, the curing assemblies 308*a-b* may be low-pressure mercury vapor lamps configured to emit UV radiation.

More specifically, the curing assemblies 308*a-b* may be configured to emit wavelengths of electromagnetic radiation subtype A (UVA), subtype B (UVB), subtype C (UVC), subtype V (UVV), or some combination thereof. UVV wavelengths generally measure between 395 nm and 445 nm. UVA wavelengths generally measure between 315 nanometers (nm) and 395 nm. UVB wavelengths generally measure between 280 nm and 315 nm. UVC wavelengths generally measure between 100 nm and 280 nm. However, one skilled in the art will recognize that these ranges may be somewhat adaptable/malleable. For instance, some embodiments may characterize wavelengths of 285 nm as UVC.

Figure 4:
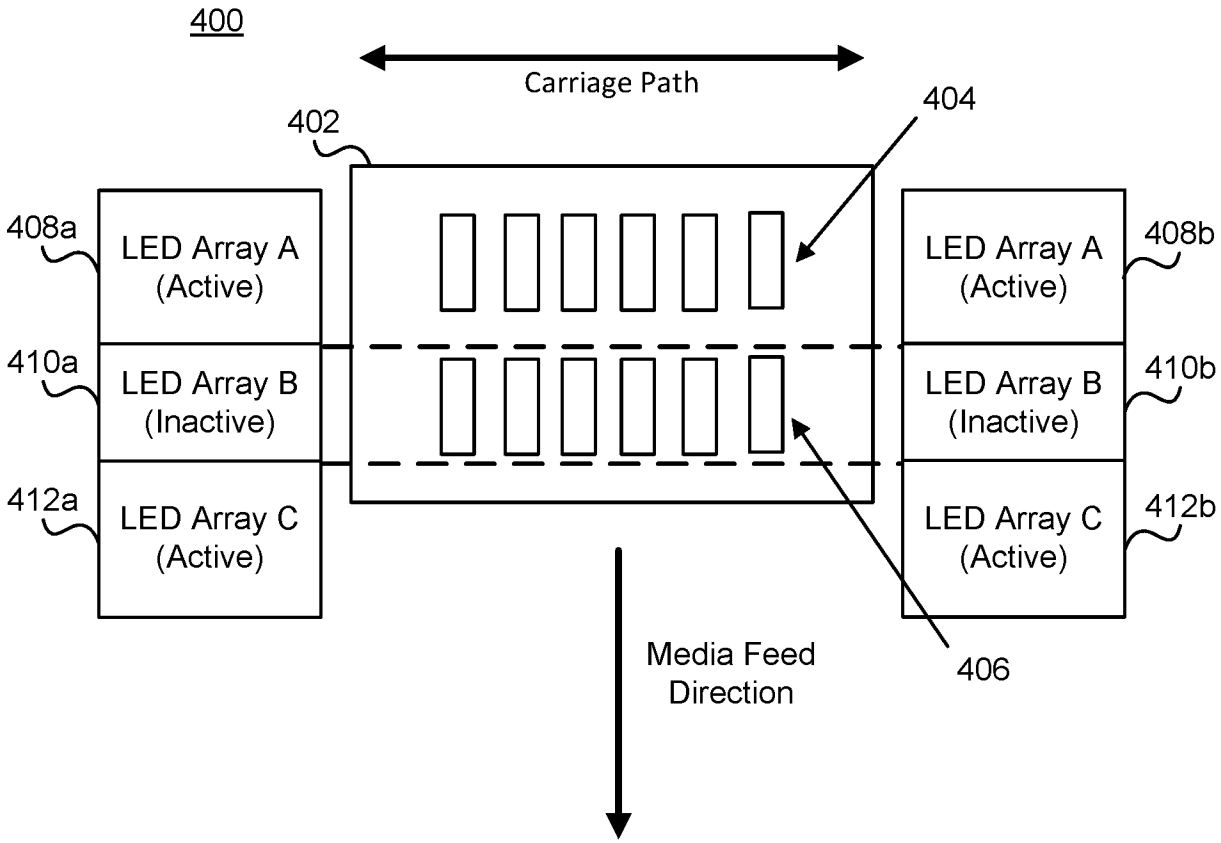
FIG. 4 depicts the underside of an inkjet printing system that is able to cure ink deposited on a substrate using a segmented array of LEDs.

FIG. 4 depicts the underside of an inkjet printing system 400 that is able to cure ink deposited on a substrate using a segmented array of LEDs. The inkjet printing system 400 can include a printer carriage 402 that houses one or more colored ink print heads 404 and one or more clear ink print heads 406. In some embodiments, the colored ink print head(s) 404 and the clear ink print head(s) 406 are housed within separate printer carriages.

The colored ink print head(s) 404 can initially deposit colored ink on the substrate that is at least partially cured by the first LED array(s) 408*a-b*. The first LED array 408 could be disposed on one or both sides of the printer carriage 402. As the substrate moves through the inkjet printing system 400 and the color layer advances to the dead zone delineated by two dashed lines, clear ink can be deposited on the substrate by the clear ink print head(s) 406. Because the second LED array(s) 410*a-b* is inactive, the section of substrate that is disposed between the dashed lines is not exposed to any radiation (and thus is not cured). The lack of radiation provides the clear ink sufficient time to settle and level out so that the gloss can be maximized.

Once the section of substrate advances past the lower dashed line, both the colored layer and the clear layer can be cured by the third LED array(s) 412*a-b*. The end result is a multilayer image that includes at least a color layer (e.g., a colored image) that is disposed beneath a clear layer. The clear layer can cover some or all of the colored layer. For example, clear ink may only be deposited on particular segments of the colored layer as a spot gloss.

Each array of LEDs could be configured to emit radiation having a particular wavelength. For example, the first LED array(s) 408*a-b* may emit UVC wavelengths, while the third LED array(s) 412*a-b* may emit UVA wavelengths. In some embodiments, one or more of the LED arrays are mixed light sources that includes multiple light sources (e.g., fluorescent bulbs or light emitting diodes) that are configured to emit two different types of electromagnetic radiation.

Figure 5A:
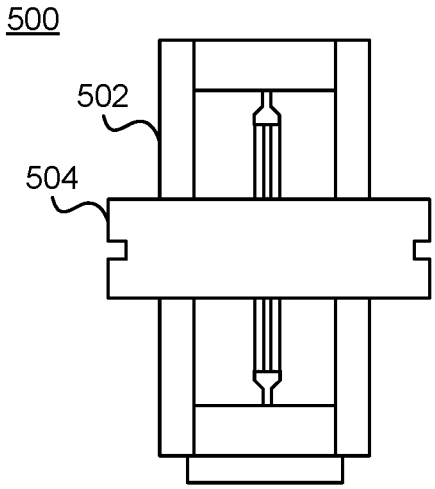
FIGS. 5A-C are bottom, side, and end views of a curing assembly that includes a shielding bracket, which blocks radiation in a particular area.
Figure 5B:
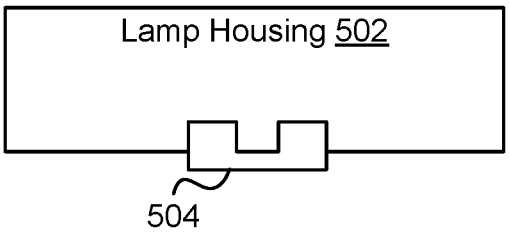
Figure 5C:
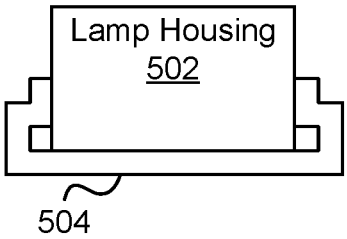

FIGS. 5A-C are bottom, side, and end views of a curing assembly 500 that includes a shielding bracket 504, which blocks radiation in a particular area. More specifically, the shielding bracket 504 can be attached the housing 502 of the curing assembly 500 using one or more fasteners. The fasteners can include magnets, mechanical clips/tracks, or some kind of adhesive. Additionally or alternatively, the shielding bracket 504 and/or the housing 502 may include holes or indentations that are suitable for screws, nuts and bolts, etc.

Generally, the shielding bracket 504 need not be made of any particular material so long as the shielding bracket 504 is able to prevent radiation that is emitted by the curing assembly 500 from reaching ink that has been deposited on a substrate disposed beneath the curing assembly 500. But the shielding bracket 504 could be comprised of a metal or plastic that is readily cleanable and suffers limited degradation over time.

As shown in FIG. 3, the shielding bracket 504 can be attached to the housing 502 to create a dead zone where the substrate is left undisturbed. More specifically, the shielding bracket 504 ensures that only certain segments of the substrate are exposed to the radiation emitted by the curing assembly at a given point in time. The shielding bracket 504 could be disposed near the front, middle, or back of the curing assembly 500. The position of the shielding bracket 504 may be determined based on the position of the print head(s) responsible for depositing clear ink on the media.

FIG. 6 is a table that shows a comparison of gloss values for different color blocks onto which a clear overcoat has been printed using various embodiments described herein and conventional printer setups. Here, for example, the sets of color blocks were printed using a Vutek H2000 Pro with light smoothing, double shutters, medium cure, and standard speed. The gloss values illustrate the effectiveness of the systems and techniques described herein in achieving high gloss. More specifically, the gloss values illustrate the importance of providing clear ink sufficient time to settle before being cured.

Figure 7:
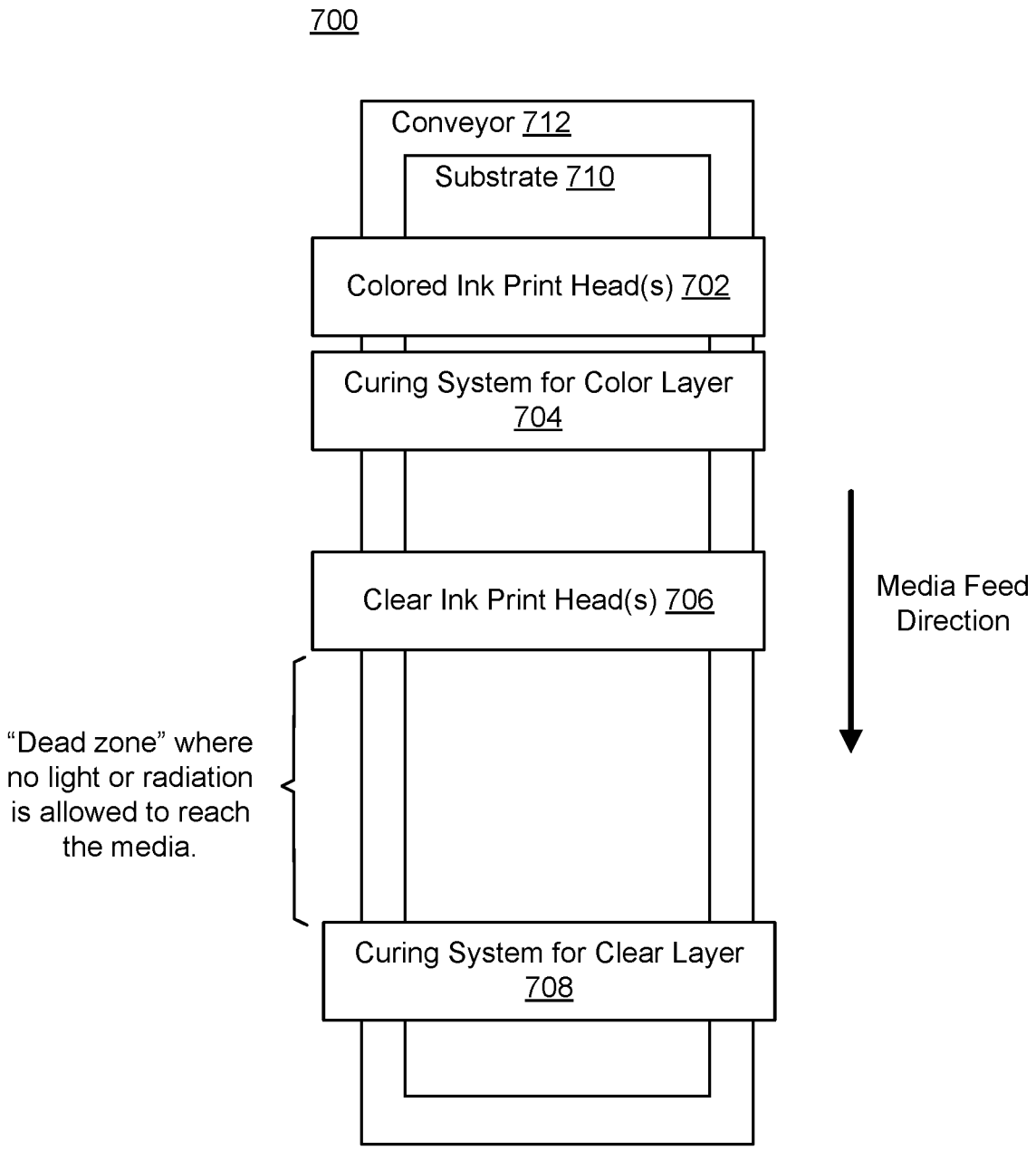
FIG. 7 shows an inkjet printing system that includes fixed print heads for depositing color inks and clear ink and curing systems for curing the ink deposited on a substrate.

FIG. 7 shows an inkjet printing system 700 that includes fixed print heads 702, 706 for depositing color inks and clear ink and curing systems 704, 708 for curing the ink deposited on a substrate 710. A conveyor 712 may be responsible for advancing the substrate 710 through the inkjet printing system 700. In some embodiments, drying systems are included instead or, or in addition to, the curing systems 704, 708.

The inkjet printing system 700 also includes a dead zone where no light or radiation (e.g., actinic UV radiation) is permitted to reach the substrate 710. The dead zone is typically created by making structural adjustments to the inkjet printing system 700. For example, a shielding bracket could be affixed to a curing system as shown by FIG. 6. As another example, a barrier could be erected the prevents radiation emitted by the curing system 704 for the color layer from passing a certain point.

The time that a section of the substrate 710 spends within the dead zone may be based on numerous factors. For example, the segment may travel through the dead zone slowly if a moderate amount of clear ink is deposited by the clear ink print head(s) 706, while the segment may stop in dead zone entirely if a large amount of clear ink is deposited by the clear ink print head(s) 706. The conveyor 712 may advance the substrate through the dead zone unimpeded if a small amount of clear ink (or no clear ink at all) was deposited on the segment by the clear ink print head(s) 706.

Numerous embodiments are also amenable to performing water-based drying in a similar fashion. That is, drying and/or heating could be performed rather than energy-based (e.g., UV) curing. In such embodiments, the curing assemblies may be replaced by heating assemblies 714 that include arc lamps, LEDs, infrared (IR) lamps, ceramic heaters, etc. Like the curing assemblies described above, the heating assemblies 714 can be blocked or removed entirely from an area adjacent to the clear ink print head(s) 706 so that the clear ink has sufficient time to settle.

Figure 8:
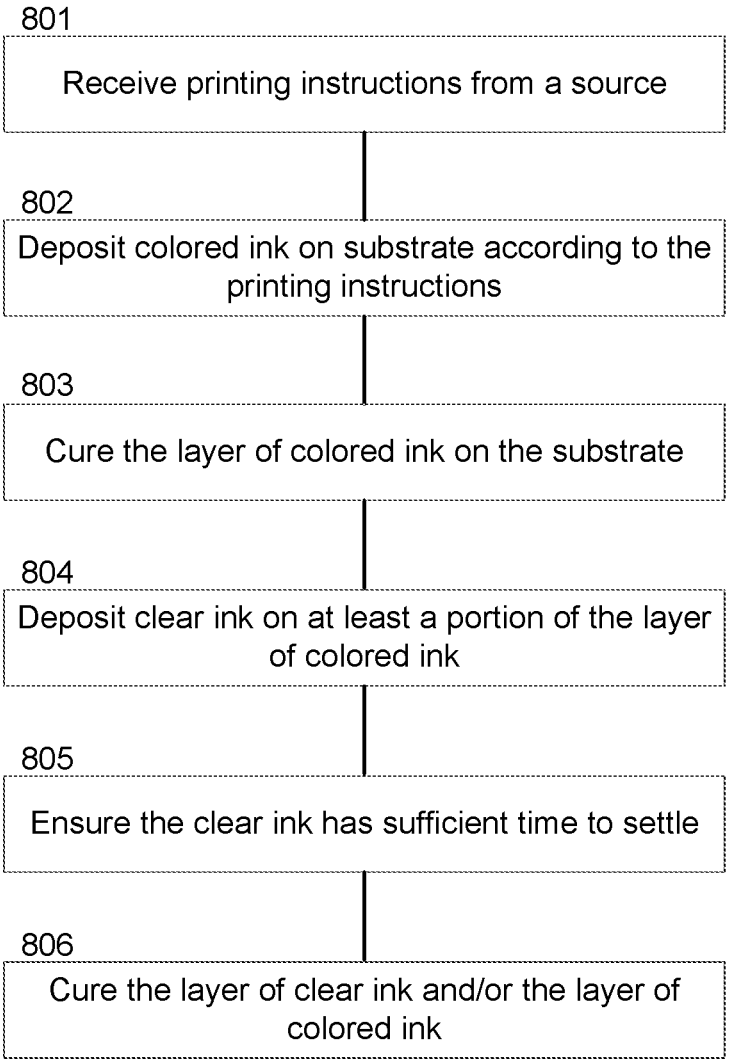
FIG. 8 depicts a process for curing a multilayer image that includes a layer of colored ink and a layer of clear ink.

FIG. 8 depicts a process 800 for curing a multilayer image that includes a layer of colored ink and a layer of clear ink. Printing instructions are initially received by an inkjet printing system from a source (step 801). The source may communicate printing instructions through a local physical connection (e.g., via a universal serial bus (USB) connection) and/or a remotely connection (e.g. via a local Wi-Fi network, Bluetooth peer to peer connection, or an Internet service provider (ISP) coupled to the local Wi-Fi network via a router).

The inkjet printing system then begins the printing process by depositing colored ink on a substrate to form a color layer in accordance with the printing instructions (step 802). The color layer is then at least partially cured by being exposed to a first curing assembling (step 803). The first curing assembly could include, for example, LEDs configured to emit UV radiation at a particular wavelength that is based at least in part on the composition of the colored ink. The color layer could be partially or entirely cured by the curing assembly during this step.

The inkjet printing system then deposits clear ink on at least a portion of the color layer to form a clear layer (step 804). The clear layer can act as a protective overcoat (e.g., for outdoor weathering, abrasion resistance, or anti-graffiti), a gloss flood coat or varnish, or a spot gloss. The inkjet printing system is designed so that the clear ink has sufficient time to settle before being cured (step 805). This can be done in multiple ways. For example, a shielding bracket could be affixed to the curing assembly that prevents radiation from reaching the substrate. As another example, sufficient space may exist between the first curing assembly and the clear ink print head(s) such that radiation does not affect clear ink deposited onto the substrate.

The clear layer is then at least partially cured by a second curing assembly (step 806). In some embodiments, the first and second curing assemblies are part of the same curing assembly. For example, a shielding bracket may separate a single curing assembly into multiple segments that emit radiation. However, the first and second curing assemblies could instead be distinct curing assemblies. In such embodiments, the distinct curing assemblies could be configured to emit the same or different types of radiation.

Unless contrary to physical possibility, it is envisioned that the steps described above may be performed in various sequences and combinations. Additional steps could also be included in some embodiments. For example, a clear layer could be initially deposited by the clear ink print head(s) onto the substrate as a clear primer that is disposed beneath the color layer. Those skilled in the art will also appreciate that the steps described here could be altered in a variety of ways. For instance, the order of the steps may be rearranged, sub-steps may be performed in parallel, some illustrated steps may be omitted, other steps may be included, etc. Moreover, certain steps may be consolidated into a single step and the actions represented by a single step may be alternatively represented as a collection of sub-steps.

Chemistry of Clear Inks

The clear, radiation-curable inks described above preferably comprise the following components at the certain composition levels, which are listed below:

- Radiation-curable Oligomers: 0-30%
- Radiation-curable Monomers: 40-90%
- Photoinitiators: 1-10%
- Light stabilizers and UV absorbers: 0-8%
- Flow and Leveling Additives: 0-3%
- Surfactants for Surface Energy Control: 0-2%
- Antioxidants, Thermal Stabilizers, and Polymerization Inhibitors: 0-3%
- Biocides: 0-3%
- Nanoparticles for Surface Hardness: 0-5%

Note, however, that various types of clear, energy (e.g., radiation or convection) curable inks could include some or all of these components, as well as additional components not described here.

Processing System

Figure 9:
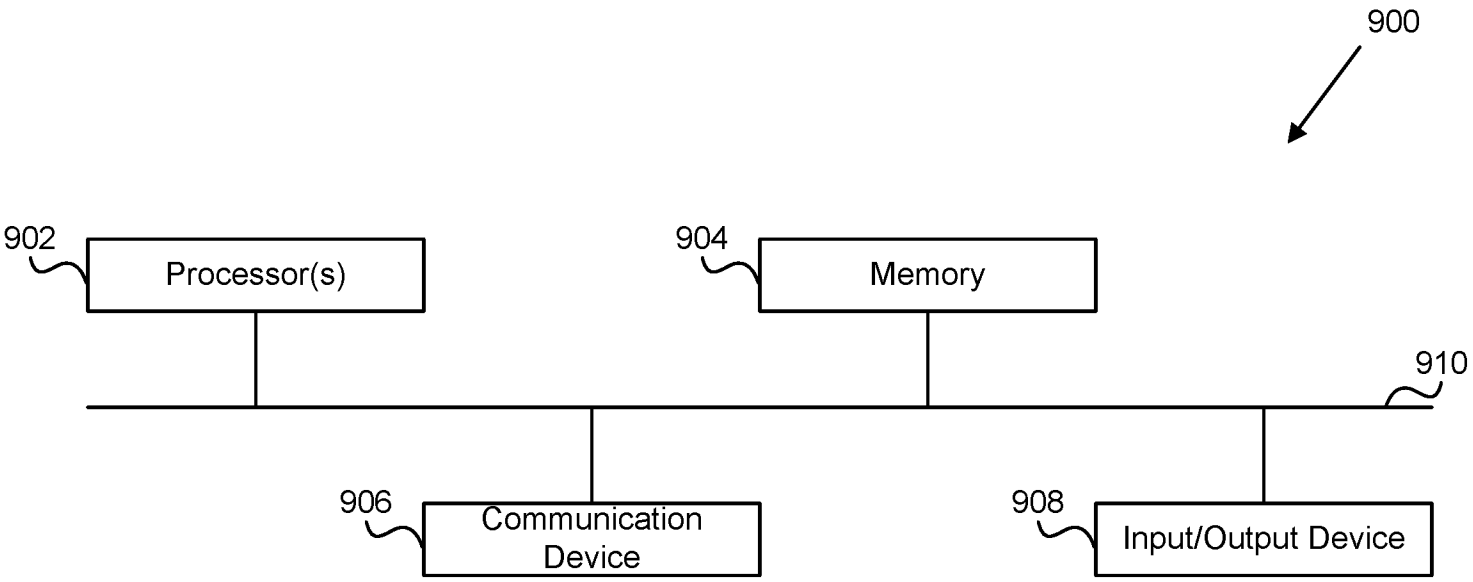
FIG. 9 is a block diagram of a processing system that may be used to implement certain features of some of the embodiments described herein.

FIG. 9 is a block diagram of a processing system 900 that may be used to implement certain features of some of the embodiments described herein. The processing system 900 may include or be part of a server, a personal computer, a tablet, a personal digital assistant (PDA), a mobile phone, a network-connected ("smart") device, or another electronic device capable of providing instructions to a printing system.

The processing system 900 may include one or more central processing units ("processors") 902, memory 904, a communication device 906, and an input/output device 908 (e.g., keyboards, pointing devices, and touch-sensitive displays) that are connected to an interconnect 910.

The interconnect 910 is illustrated as an abstraction that represents any one or more separate physical buses, point-to-point connections, or both connected by appropriate bridges, adapters, or controllers. The interconnect 910, therefore, may include, for example a system bus, a peripheral component interconnect (PCI) bus or PCI-Express bus, a HyperTransport or industry standard architecture (ISA) bus, a small computer system interface (SCSI) bus, a universal serial bus (USB), IIC (12C) bus, or an Institute of Electrical and Electronics Engineers (IEEE) standard 1394 bus, also referred to as "Firewire."

The memory 904 is computer-readable storage media that may store instructions that implement at least portions of the various embodiments. In addition, the data structures and message structures may be stored or transmitted via a data transmission medium (e.g., a signal on a communications link). Various communications links may be used, such as the Internet, a local area network, a wide area network, or a point-to-point dial-up connection. Thus, computer readable media can include computer-readable storage media (e.g., non-transitory media) and computer-readable transmission media.

The instructions stored in memory 904 can be implemented as software and/or firmware to program one or more processors 902 to carry out the actions described above. In some embodiments, such software or firmware may be initially provided to the processor 902 by downloading it from a remote system through the communication device 906, such as an Ethernet adapter, cable modem, Wi-Fi adapter, cellular transceiver, or Bluetooth transceiver.

The various embodiments of the invention introduced herein can be implemented by, for example, programmable circuitry (e.g., one or more microprocessors), programmed with software and/or firmware, entirely in special-purpose hardwired (i.e., non-programmable, circuitry), or in a combination of such forms. Special-purpose hardwired circuitry may be in the form of, for example, one or more ASICs, PLDs, FPGAs, etc.

Remarks

The above description and drawings are illustrative and are not to be construed as limiting. Numerous specific details are described to provide a thorough understanding of the disclosure. However, in certain instances, well-known details are not described in order to avoid obscuring the description. Further, various modifications may be made without deviating from the scope of the embodiments.

Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described that may be exhibited by some embodiments and not by others. Similarly, various requirements are described that may be requirements for some embodiments but not for others.

The terms used in this specification generally have their ordinary meanings in the art, within the context of the disclosure, and in the specific context where each term is used. Certain terms that are used to describe the disclosure are discussed above, or elsewhere in the specification, to provide additional guidance to the practitioner regarding the description of the disclosure. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that the same thing can be said in more than one way. For instance, one will recognize that "memory" is one form of a "storage" and that the terms may on occasion be used interchangeably.

Consequently, alternative language and synonyms may be used for any one or more of the terms discussed herein, and special significance is not to be placed on whether or not a term is elaborated or discussed herein. Synonyms for certain terms are provided. A recital of one or more synonyms does not exclude the use of other synonyms. The use of examples anywhere in this specification, including examples of any term discussed herein, is illustrative only and is not intended to further limit the scope and meaning of the disclosure or of any exemplified term. Likewise, the disclosure is not limited to the various embodiments given in this specification.

Without intent to further limit the scope of the disclosure, examples of instruments, apparatus, methods and their related results according to the embodiments of the present disclosure are given above. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains. In the case of conflict, the present document, including definitions, will control.

The invention claimed is:

1. An apparatus comprising:

a curing assembly that includes— a light source configured to emit radiation toward a surface of a moving substrate, and a housing in which the light source is mounted; and a bracket that is statically secured to at least one sidewall of the housing, wherein the bracket is positioned between the light source and the surface of the moving substrate such that the radiation is prevented from reaching a section of the surface of the moving substrate onto which clear ink has been deposited for an amount of time during which the clear ink is permitted to settle.

2. The apparatus of claim 1, wherein the bracket is positioned orthogonal to a propagation direction of the radiation.

3. The apparatus of claim 1, wherein the bracket is positioned substantially in line with a print head configured to deposit clear ink onto the surface of the moving substrate.

4. The apparatus of claim 1, wherein the bracket is positioned downstream of a print head configured to deposit colored ink onto the surface of the moving substrate in a media feed direction, and wherein the colored ink is at least partially cured by the radiation immediately upon being deposited onto the surface of the moving substrate.

5. The apparatus of claim 1, wherein the light source includes:

a first light-emitting diode configured to emit wavelengths within a first range; and a second light-emitting diode configured to emit wavelengths within a second range different than the first range.

6. The apparatus of claim 5, wherein the clear ink includes a photoinitiator adapted to absorb wavelengths within either the first range or the second range.

7. The apparatus of claim 5, wherein the first and second ranges correspond to electromagnetic radiation of subtype A (UVA), subtype B (UVB), subtype C (UVC), or subtype V (UVV).

8. The apparatus of claim 1, wherein the curing assembly is positioned alongside a reciprocating carriage configured to shuttle laterally over the surface of the moving substrate as a conveyor mechanism moves the moving substrate in a media feed direction, and wherein the reciprocating carriage includes at least one print head configured to deposit colored ink onto the surface of the moving substrate, and at least one print head configured to deposit clear ink onto the surface of the moving substrate.

9. The apparatus of claim 1, wherein the bracket is statically secured along a central segment of the housing such that the surface of the moving substrate is exposed to the radiation before and after being located beneath the bracket.

10. A method comprising:

depositing clear ink on a first section of a substrate being moved through an inkjet printing system in a media feed direction by a conveyor;

allowing the clear ink to settle into a layer by retarding the conveyor immediately after the clear ink has been deposited onto the first section of the substrate, wherein said retarding causes the first section of the substrate to be disposed beneath a radiation shielding feature configured to prevent radiation from reaching the substrate; and curing the clear ink by exposing the first section of the substrate to a first light source configured to emit ultraviolet radiation.

11. The method of claim 10, wherein the radiation shielding feature is an inactive light source positioned substantially in line with a print head configured to deposit the clear ink onto the substrate.

12. The method of claim 10, wherein the radiation shielding feature is a bracket positioned substantially in line with a print head configured to deposit the clear ink onto the substrate.

13. The method of claim 10, further comprising:

depositing colored ink onto a second section of the substrate; and curing the colored ink by exposing the second section of the substrate to a second light source configured to emit ultraviolet radiation.

14. The method of claim 13, wherein the clear ink is deposited onto the substrate after the colored ink has been cured, and wherein the first section of the substrate and the second section of the substrate at least partially overlap.

15. The method of claim 13, wherein the first and second light sources are configured to emit electromagnetic radiation of subtype A (UVA), subtype B (UVB), subtype C (UVC), subtype V (UVV), or any combination thereof.

16. The method of claim 13, wherein the first light source is configured to emit wavelengths within a first range, and wherein the second light source is configured to emit wavelengths within a second range different than the first range.

17. The method of claim 10, wherein the clear ink is permitted to settle for a particular amount of time prior to exposure to the first light source, and wherein the particular amount of time corresponds to a width of the radiation shielding feature.

18. The method of claim 17, wherein the particular amount of time is based on a composition of the clear ink, a total surface area that includes colored ink and clear ink, a total amount of deposited clear ink, or any combination thereof.

19. An apparatus comprising:

a first curing assembly configured to at least partially cure colored ink deposited onto a substrate moving along a conveyor in a media feed direction by emitting electromagnetic radiation within a first range; and a second curing assembly configured to at least partially cure clear ink deposited onto the substrate following deposition of the colored ink by emitting electromagnetic radiation within a second range different than the first range, wherein the second curing assembly is offset from a print head that deposits the clear ink in the media feed direction by a predetermined distance to provide the clear ink time to settle into a layer prior to exposure to the electromagnetic radiation within the second range.

20. The apparatus of claim 19, wherein the first range corresponds to electromagnetic radiation of subtype C (UVC), and wherein the second range corresponds to electromagnetic radiation of subtype A (UVA), subtype B (UVB), subtype V (UVV), or any combination thereof.

* * * * *